United States Patent [19]

Wiebe

[11] 4,380,896

[45] Apr. 26, 1983

[54] ANNULAR COMBUSTOR HAVING CERAMIC LINER

[75] Inventor: David J. Wiebe, Palm Beach Gardens, Fla.

[73] Assignee: The United States of America as represented by the Secretary of the Army, Washington, D.C.

[21] Appl. No.: 189,536

[22] Filed: Sep. 22, 1980

[51] Int. Cl.[3] ..... F02C 7/20

[52] U.S. Cl. ..... 60/39.32; 60/753

[58] Field of Search ..... 60/39.36, 753, 39.32, 60/322; 431/351, 352, 353

[56] References Cited

U.S. PATENT DOCUMENTS

| | | | |
|---|---|---|---|
| 3,088,279 | 5/1963 | Diedrich | 60/39.36 |
| 3,186,168 | 6/1965 | Ormerod et al. | 60/39.32 |
| 3,594,109 | 7/1971 | Penny | 60/753 |
| 3,918,255 | 11/1975 | Holden | 431/352 |
| 3,990,231 | 11/1976 | Irwin | 60/753 |
| 4,030,875 | 6/1977 | Grondahl et al. | 60/753 |

*Primary Examiner*—Carlton R. Croyle
*Assistant Examiner*—Jeffrey A. Simenauer
*Attorney, Agent, or Firm*—Nathan Edelberg; Robert P. Gibson; Norman L. Wilson, Jr.

[57] ABSTRACT

An annular combustor for a jet turbine engine of generally rectangular cross-section having an axially-projecting aft exhaust outlet is lined by a plurality of circumferentially-extending heat-insulating liner segments, preferably ceramic, spaced from the metal shell of the combustor by spring-like spacers. The liner segments have offset tabs at their edges to slidably mate with each other and with retaining clips adjacent to the exhaust outlet, thereby being slidably secured to accept expansion of the metal shell without placing appreciable stress on the liner segments. Arcuate, generally planar liner segments along the forward and aft walls of the combustor are keyed in place by a radially-inward flanged liner segment along the outer perimetrical wall of the shell.

8 Claims, 6 Drawing Figures

ANNULAR COMBUSTOR HAVING CERAMIC LINER

BACKGROUND OF THE INVENTION

The present invention relates to annular combustors for turbine engines.

Turbine engines, such as of the type used for aircraft, commonly utilize an annular-shaped enclosure as a combustion chamber, mounted aft of the compressor, forward of the turbine which drives the compressor, and surrounding the shaft coupling the turbine and compressor. Inlets on the forward side of the enclosure accept compressed combustion air from the compressor; fuel nozzles and igniters are provided at its outer side. An aft outlet directs the exhaust gases onto the turbine.

The combustor must be constructed to withstand extremely high temperatures.

SUMMARY OF THE INVENTION

The principal purpose of the present invention is to provide an annular combustor for a turbine engine having a heat-insulating liner which will withstand the extremely high temperatures encountered within such combustors.

Briefly summarized, the inventive annular combustor is comprised of an annular metal shell lined by an insulating layer of slidably interlocking heat-insulating liner segments, preferably of ceramic material such as silicon nitride. The annular metal shell has a generally rectangular cross-section made up of three detachable portions, a first outer perimetrical wall portion, a second aft wall portion, and a third portion forming a forward wall and inner perimetrical wall. An axially-projecting exhaust outlet is provided at the intersection of the aft and inner perimetrical walls. On the inner side of the shell, spring-like spacers are provided to space the liner from the shell and retaining clips are provided adjacent to the exhaust outlet.

The liner is comprised of a plurality of circumferentially-extending liner segments of the three types, each having offset tabs at their edges to slidably mate with the retaining clips adjacent to the exhaust outlet and with each other. These types of segments include forward liner segments of generally planar arcuate shape extending along the forward wall of the shell and flanged to extend along the inner perimetrical wall, aft liner segments of planar arcuate shape extending along the aft wall of the shell, and radially-inward flanged endwall liner segments extending along the outer perimetrical wall of the shell.

The ceramic liner insulates the metal shell from the heat generated within the combustor. Nevertheless, the metal shell expands more than the ceramic liner, having a substantially greater coefficient of thermal expansion. Due to their slidable mating, no appreciable stress is placed on the liner segments on such expansion of the metal shell.

DESCRIPTION OF THE PREFERRED EMBODIMENT

The present invention is an annular combustor for a jet turbine engine having a plurality of interlocking ceramic segments lining the inner side of a metal shell, the segments being held in their interlocking position by spring-like spacers on the inner side of the metal shell and retaining clips on the inner side of the shell adjacent to an outlet at the aft side of the combustor.

Figure 3:
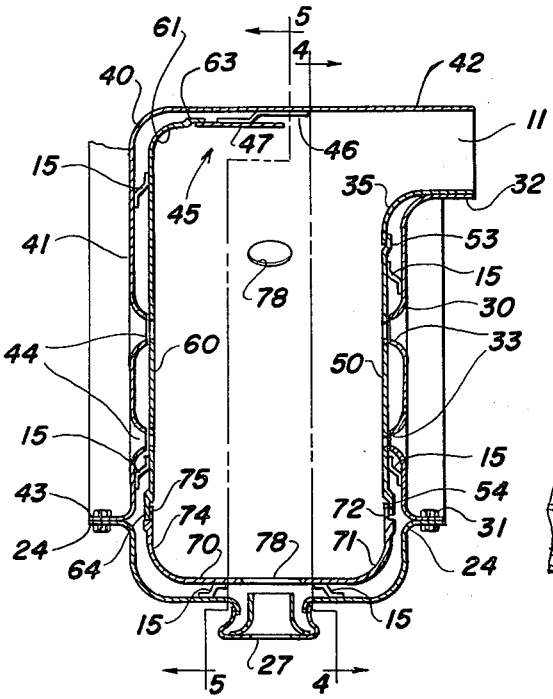
FIG. 3 is a vertical section taken along the line 3—3 of FIG. 1 showing a section of the metal shell and ceramic liner of the combustor.

Described in detail, a preferred embodiment of the present invention includes an annular metal shell, generally designated 10, having a generally rectangular cross-section, as shown in FIG. 3, with an aft-projecting axial exhaust outlet 11.

Figure 1:
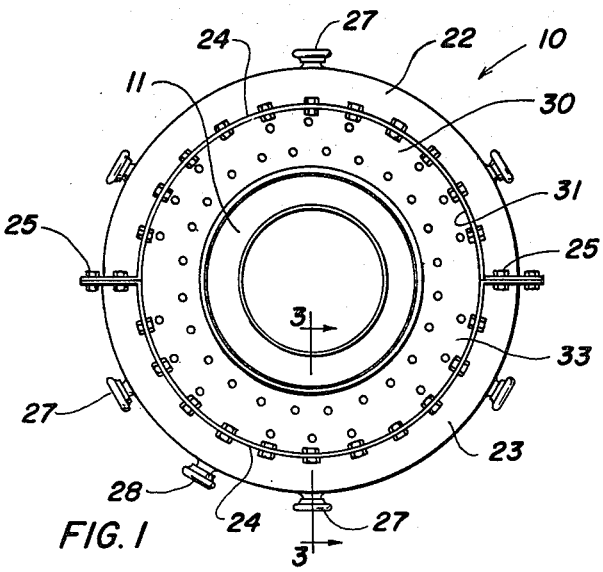
FIG. 1 is an aft elevation of an annular combustor embodying the present invention.
Figure 2:
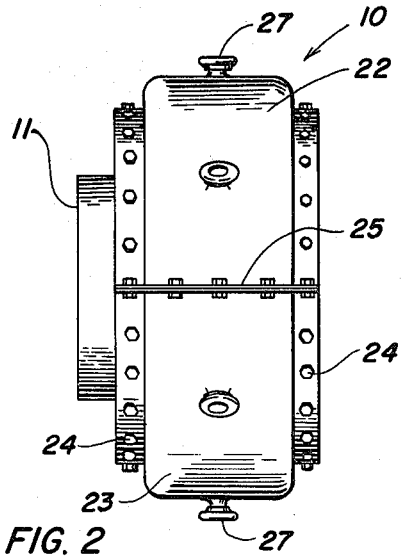
FIG. 2 is a side elevation of the annular combustor of FIG. 1.

The metal shell is made up of a first wall portion of U-shaped cross-section forming an outer perimetrical wall 21 (FIG. 4) of U-shaped cross section, as shown in FIG. 3, including an upper outer perimetrical wall part 22 and a lower outer perimetrical wall part 23, as shown in FIGS. 1 and 2. The outer perimetrical wall parts 22, 23 have axially-projecting flanges 24 at their radially inner edges and radially projecting flanges 25 at their circumferential edges, by which the two parts 22, 23 are bolted together. Fuel nozzle bosses 27 an an igniter bosses 28 are spaced around the outer perimetrical wall 21. A plurality of pairs of spacers 15, having a generally Z-shaped cross-section, and preferably of springy metal, are spaced along and fixedly attached to the inner side of the outer perimetrical wall 21. These will serve to space the ceramic segments from the metal shell, as described below.

The annular metal shell 10 further includes a second or aft wall portion 30, generally washer-shaped, having an axially-projecting flange 31 at its radially outer side, by which the aft wall portion 30 is bolted to the axially-aft-projecting flange 24 of the outer perimetrical wall 21. The aft wall portion 20 further has an axially-extending outward flange 32 on its radially inner side which forms the radially outer wall of the exhaust outlet 11. A plurality of compressed air inlets 33 are provided in the aft wall portion 30. The aft wall portion 30 also has, on its inner side, a plurality of pairs of the spring-like spacers 15. At its radially inner end, the aft wall portion 30 has a first circumferential retaining clip 35 mounted to the axial flange 32 and curving to project radially outward spaced inward of the wall 30, whereby to retain the ceramic segments adjacent to the radially outer side of the exhaust outlet 11.

The metal shell 10 is completed by a third or forward wall portion 40 having a generally L-shaped cross-section to provide the forward and inner perimetrical walls of the shell 10, including a radially-extending portion 41 forming the forward wall and an aft projecting end or inner perimetrical wall 42 forming the radially inner wall of the exhaust outlet 11. At the radially outer end of the forward wall 41 is provided an outward flange 43, by which the forward wall portion 40 is bolted to the forward axial flange 24 of the outer perimetrical wall portion 21. The forward wall 41 likewise has a plurality of compressed air inlets 44. Again, a plurality of pairs of the spring-like spacers 15 are provided on the inner side of the forward wall 41 of the shell 10. On the inner side of the inner perimetrical wall 42 of the shell 10 is provided a second circumferential forward-projecting retaining clip 45 spaced inward of the wall 42, which serves to retain the ceramic liner segments adjacent to the forward side of the aft outlet 11. The second retaining clip 45 may be formed of a plurality of generally Z-shaped spacers 46 fixedly attached to a cylindrical ring 47 and wall 42, as shown in FIG. 3.

The inner ceramic liner is made up of three types of slidably mating heat insulating liner segments, preferably ceramic, and in the preferred embodiment made of silicon nitride. The liner segments have a substantially lower coefficient of thermal expansion than that of the metal shell; the slidable mating relationship of the liner segments permits expansion of the metal shell without placing any appreciable tension, compression, or other stress on the liner segments.

Figure 4:
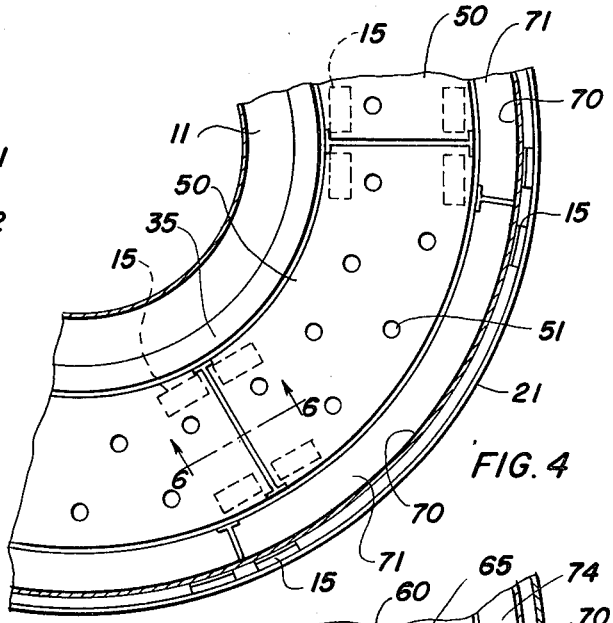
FIG. 4 is a vertical section taken along line 4—4 of FIG. 3 showing the inner side of the combustor aft wall.
Figure 6:
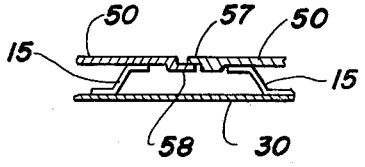
FIG. 6 is a section taken along line 6—6 of FIG. 4, showing the slidably intermating relationship of two aft liner segments.

A plurality of identical aft liner segments 50, shown in FIGS. 3 and 4, having a generally planar arcuate shape and a linear cross-section, are provided extending circumferentially along the aft wall 30 of the metal shell 10, spaced therefrom by the spring-like spacers 15. A plurality of inlet holes 51 are provided, each inward of and aligned with the compressed air inlets 33 of the outer aft wall 30. As best shown in FIG. 3, the radially inner edge of each aft liner segment 50 has a radially-inward-extending outwardly-offset tab 53 along its length, whose inward side slidably mates with the outward side of the radially-outward projecting portion of the first circumferential retaining clip 35. By providing the tab 53 outwardly offset, the retaining clip 35 prevents excessive vertical movement of the aft liner segment 50. Each of the aft liner segments 50 likewise has a radially-outward-extending outwardly-offset tab 54 at its radially outer edge, slidably mating with a similar provision of an adjacent endwall liner segment, decribed below. As shown in FIG. 6, the radially-extending adjacent edges of the aft liner segments 50 have slidably mating tabs, including an inwardly-offset tab 57 at one end of each segment 50 and an outwardly offset tab 58 at the opposite end.

Figure 5:
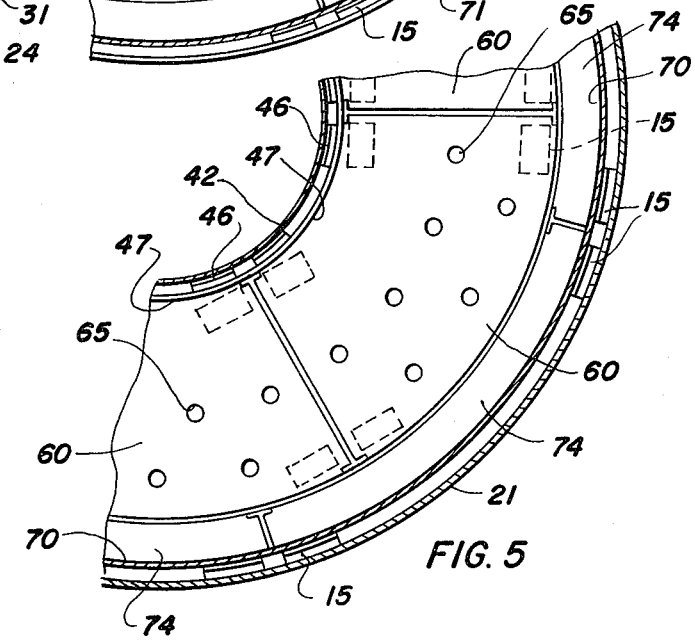
FIG. 5 is a vertical section taken along line 5—5 of FIG. 3 showing the inner side of the combustor forward well.

As shown in FIGS. 3 and 5, the liner also includes a plurality of identical forward liner segments 60, having a generally planar arcuate shape and extending along and spaced from the radially forward wall 41 of the metal shell 10. Each forward liner segment 60 curves into an aft-extending integral flange 61 extending along the inner perimetrical shell wall 42, ending in a circumferential aft-extending outwardly-offset tab 63 whose inward side slidably mates with the outward side of the ring 47 of the second circumferential retaining clip 45. In a similar manner, the radially-outward-projecting edge of the forward liner segment 60 ends in a radially-outward-extending outwardly-offset tab 64, also slidably mating with a tab on an endwall liner segment, described below. Each forward liner segment 60 also has a plurality of holes 65 inwardly adjacent of and aligned with the compressed air inlets 44 of the forward wall portion 40 of the shell 10. The forward liner segments 60 also have offset slidably mating tabs at their radially-extending adjacent edges, similar to FIG. 6.

Finally, the third type of liner segments provided are outer perimetrical endwall liner segments 70 curved to extend along the outer perimetrical shell wall 21, spaced therefrom by the spring-like spacers 15. The endwall segments 70, all identical, have an aft radially-inward-extending integral flange 71 ending at its radially inward edge in radially-inward-extending inwardly-offset tabs 72, slidably mating with the radially outward tabs 54 of the aft liner segments 50. Likewise, the endwall segments 70 each have a forward radially-inward-extending integral flange 74 ending at its radially-inward edge in a radially-inward-extending inwardly-offset tab 75 slidably mating with the radially-outward-extending tab 64 of the forward liner segments 60. Again, the endwall segments 70 have mating offset tabs at their adjacent edges, similar to FIG. 6, and have holes 78 radially inward of and aligned with the fuel nozzle bosses 27 and igniter bosses 28.

The endwall segments 70, held inward by the spacers 15 on the inner side of the outer perimetrical shell wall 21, slidably secured the aft and forward liner segments 50, 60 outward against their spacers 15. The endwall segments 70 may be said to serve as a key to hold the other segments 50, 60 in place. When the outer metal shell 10 expands more than the liner segments on combustion within the combustor, their mating tabs accept this relative movement; thereby no tension, compression, or other appreciable stress is placed on the liner segments, which may be relatively brittle. The inward force of the spring-like spacers, resisted by the retaining clips, etc., is thought to place relatively little stress on the liner segments, a principal advantage of this inventive construction. Other advantages include the ease of replacement of the individual segments, since they are secured slidably.

The above described embodiment is merely an example of a construction employing the present invention, it will be apparent that modifications may be made within the scope of the invention. For example, other spacer means and retaining clip means on the inner side of the outer shell may be utilized. Heat-insulating interlocking lining segments of modified shapes may be utilized on the inner side of annular metal shells of various cross-sections, as well as the generally rectangular cross-section shown. The slidably mating provisions at their edges may take on varying shapes. From these examples, other modifications may suggest themselves.

What is claimed is:

1. An annular combustor for use in a turbine engine, comprising an annular metal shell having a generally rectangular cross-section and including an outer perimetrical wall, an inner perimetrical wall, an aft wall, and a forward wall, the shell having an axially-projecting aft outlet at the intersection of the aft wall and inner perimetrical wall, inwardly-projecting spacer means mounted on the inner side of the shell, retaining clip means on the inner side of the shell adjacent to the aft outlet, and a plurality of heat-insulating liner segments on the inner side of the metal shell, spaced therefrom by the spacer means, the plurality of liner segments including outer perimetrical endwall liner segments, curved to extend along the outer perimetrical wall of the metal shell, each endwall segment having, at each of its forward and aft sides, a radially-inward-extending flange whose edge ends in radially-inward-extending inwardly-offset tab means, aft wall liner segments of planar arcuate shape, extending along the aft wall of the metal shell, each having radially-inward-extending outwardly-offset tab means at its radially inner edge matable with the retaining clip means, and having radially-outward-extending outwardly-offset tab means at its radially outer edge matable with the tab means of the endwall segments, and further including forward wall liner segments of generally planar arcuate shape, each extending along the forward wall of the metal shell to end in a radially-outward-extending edge having radially-outward-extending outwardly-offset tab means matable with the tab means of the endwall segments, and each of the forward wall liner segments having an inward flange at its radially inner end extending along the inner perimetrical wall ending in an aft-extending edge having aft-extending outwardly-offset tab means matable with the retaining clip means.

2. The annular combustor defined in claim 1, wherein the liner segments have, on the adjacent edges of the endwall segments and on the adjacent edges of the aft segments and forward segments, slidably intermatable tabs.

3. An annular combustor for use in a turbine engine, comprising an annular metal shell including a first detachable shell portion forming an outer perimetrical wall, a second detachable shell portion forming an aft wall, and a third detachable shell portion forming a forward wall and inner perimetrical wall, the shell having an axially-projecting aft outlet at the intersection of the aft wall and inner perimetrical wall, inwardly-projecting spacer means mounted on the inner side of the shell, first retaining clip means on the inner side of the metal shell adjacent to and forward of the axially-projecting outlet, and second radially-outward-projecting retaining clip means on the inner side of the aft wall adjacent to the aft-projecting outlet, and further comprising a plurality of circumferentially-extending heat-insulating liner segments on the inner side of the metal shell, spaced therefrom by the spacer means, the plurality of liner segments including forward liner segments extending along the forward wall of the metal shell, being free to move relative to the spacer means, and being slidably matable, at their radially inner edges, with the first retaining clip means, aft liner segments of planar arcuate shape extending along the aft wall of the metal shell, being free to move relative to the spacer means and being slidably matable, at their radially inner edges, with the second retaining clip means, and outer perimetrical endwall liner segments extending along the outer perimetrical wall of the metal shell and slidably matable, at their forward and aft ends, with the forward and aft liner segments, whereby the endwall liner segments secure the forward and aft liner segments in place.

4. The annular combustor defined in claim 3, wherein the metal shell further has fuel nozzle inlet means and igniter means in the outer perimetrical wall, and combustion air inlet means in the aft wall and forward wall, and wherein the endwall liner segments have hole means radially inward of and adjacent to the fuel nozzle inlet means and igniter means, and the rear liner segments and forward liner segments have hole means outwardly adjacent to the combustion air inlet means.

5. The annular combustor defined in claim 3, wherein the first portion of the annular metal shell is formed in two semicircular parts.

6. The annular combustor defined in claim 1 or 3, wherein the liner segments are of ceramic material.

7. The annular combustor defined in claim 1 or 3, wherein the liner segments are of silicon nitride.

8. The annular combustor defined in claim 1 or 3, wherein the inwardly-projecting spacer means is of springy metal.

* * * * *